US008944569B2

(12) United States Patent
Moriya et al.

(10) Patent No.: US 8,944,569 B2
(45) Date of Patent: Feb. 3, 2015

(54) LIQUID DISCHARGE HEAD AND RECORDING APPARATUS USING THE SAME

(71) Applicant: Canon Kabushiki Kaisha, Tokyo (JP)

(72) Inventors: Takatsugu Moriya, Tokyo (JP); Ryohei Goto, Fujisawa (JP); Kazuhiro Yamada, Yokohama (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/172,655

(22) Filed: Feb. 4, 2014

(65) Prior Publication Data

US 2014/0218443 A1 Aug. 7, 2014

(30) Foreign Application Priority Data

Feb. 7, 2013 (JP) ..... 2013-022313

(51) Int. Cl.
*B41J 2/05* (2006.01)
*B41J 29/38* (2006.01)
*B41J 2/14* (2006.01)

(52) U.S. Cl.
CPC ..... *B41J 2/14427* (2013.01)
USPC ..... 347/65; 347/17

(58) Field of Classification Search
CPC ..... B41J 2/1404; B41J 2/1631; B41J 2/1603; B41J 2/1639; B41J 2202/11; B41J 2/04563; B41J 11/002; B41J 2/0458; B41J 2/175; B41J 29/38; B41J 2/04541; B41J 2/04528; B41J 2/04553
See application file for complete search history.

(56) References Cited

U.S. PATENT DOCUMENTS

2005/0195238 A1* 9/2005 Eguchi et al. ..... 347/20

FOREIGN PATENT DOCUMENTS

JP 2004-209764 A 7/2004
JP 2007-168112 A 7/2007

* cited by examiner

*Primary Examiner* — Lisa M Solomon
(74) *Attorney, Agent, or Firm* — Canon USA Inc. IP Division

(57) ABSTRACT

A liquid discharge head includes: a recording element substrate including a discharge port group for discharging liquid and a supply port for supplying the liquid to the discharge port group; a supporting member including a liquid chamber for storing the liquid therein, the supporting member being configured to support the recording element substrate; a flow path formed between the liquid chamber and the supply port and configured to allow the liquid to flow therethrough along a main surface of the recording element substrate on which the supply port opens; and a plurality of through holes communicating the liquid chamber with the flow path. A sum of opening areas of the plurality of through holes per unit area is greater in a region having relatively high temperature than that in a region having relatively low temperature in an in-plane direction of the main surface of the recording element substrate.

9 Claims, 10 Drawing Sheets

LIQUID DISCHARGE HEAD AND RECORDING APPARATUS USING THE SAME

BACKGROUND OF THE INVENTION

1. Field of the Invention

The present invention relates to a liquid discharge head configured to discharge liquid such as ink and a recording apparatus including the liquid discharge head.

2. Description of the Related Art

A thermal ink jet system is known as a liquid discharge method of an ink jet recording apparatus configured to discharge ink as liquid to a recording material to perform recording. The thermal ink jet system applies heat to the liquid (ink) to boil the liquid, and uses the foaming power thereof. A recording element substrate is used in a liquid discharge head used in the thermal ink jet system in order to discharge the liquid. The recording element substrate includes a recording element including a plurality of heating resistor elements (heaters) as a liquid discharge unit, a supply flow path configured to supply liquid to the heaters, a supply port configured to supply the liquid to the supply flow path, and a discharge port configured to discharge the liquid according to discharge energy generated in the heaters. In the ink jet recording apparatus, in order to enable higher-speed and higher-quality recording, heaters are densely disposed in the liquid discharge head, and the heaters are driven at high frequency. The power supply required for the liquid discharge head increases with these measures.

When the power supply increases, the temperature rise width of the overall liquid discharge head during driving increases, which may influence discharge performance depending on an achieved temperature. The temperature of the liquid in the liquid discharge head increases. According to this, a liquid discharge quantity also increases. As a result, when the temperature of the liquid discharge head rapidly increases, a recording density increases even if the same image is recorded, which may cause image density unevenness.

For the above reasons, many measures for emitting heat outside have conventionally been taken for the liquid discharge head. A liquid discharge head described in Japanese Patent Application Laid-Open No. 2007-168112 includes a heat transport unit such as a heat pipe in a liquid discharge head to emit heat outside via a heat transport medium such as a coolant. A liquid discharge head described in Japanese Patent Application Laid-Open No. 2004-209764 includes a partial structure formed by using a porous member having holes impregnated with liquid. The liquid impregnating the porous member absorbs the heat of the liquid discharge head, and is ejected outside, to emit the heat outside. This configuration can eject the liquid absorbing the heat in a discharge operation using the liquid to be discharged as impregnation liquid.

However, a further increased recording speed causes a problem. Generally, a recording element substrate is formed into a rectangular shape. The recording element substrate has a long side and a short side of several millimeters to several tens of millimeters and a thickness of several hundreds of micrometers to several millimeters. The recording element substrate includes heaters as a recording element configured to generate energy for discharging liquid. Furthermore, the recording element substrate includes a discharge port group including a plurality of discharge ports formed and arranged in a row so as to correspond to each of the heaters. In recent years, the discharge port group often includes a plurality of rows for the reason described above.

Generally, a liquid discharge head includes a recording element substrate fixed to a supporting member made of a material such as ceramic and a resin by an adhesive agent. A liquid chamber configured to supply liquid to the recording element substrate is formed in the supporting member. The liquid is supplied to the liquid chamber via a liquid chamber inflow port from a liquid tank.

Herein, as described in Japanese Patent Application Laid-Open No. 2004-209764, in the case of the configuration using the porous member, generally, the temperature of the center of the main surface of the recording element substrate is relatively high, and the temperature of the end (outer peripheral portion) of the main surface of the recording element substrate is relatively low. The configuration causes a temperature difference in the in-plane direction of the main surface. The end of the main surface of the recording element substrate is mainly joined to the supporting member by the adhesive agent. For this reason, a quantity of heat transferred to the supporting member is generally larger than that to liquid, causing a larger amount of heat to escape from the recording element substrate to the supporting member side. Thus, the configuration using the porous member cannot solve the problem of deterioration of recording quality caused by the temperature difference in the in-plane direction of the main surface of the recording element substrate, and the issue concerning a cooling unit is left to be solved.

As described in Japanese Patent Application Laid-Open No. 2007-168112, the configuration in which the liquid discharge head includes the heat pipe can improve the temperature distribution of the overall liquid discharge head. However, the configuration makes it difficult to improve the temperature distribution in the in-plane direction of the main surface of the recording element substrate having a region of several tens to several hundreds square millimeter. For this reason, the configuration described in Japanese Patent Application Laid-Open No. 2007-168112 also cannot solve the problem concerning the cooling unit.

Therefore, since the configuration of the conventional liquid discharge head makes it difficult to decrease the temperature difference in the in-plane direction of the main surface of the recording element substrate, it has been difficult to prevent deterioration of recording quality caused by heat in high-speed recording or high-density recording.

SUMMARY OF THE INVENTION

The present invention is directed to a liquid discharge head configured to prevent deterioration of recording quality caused by heat when high-speed recording is performed or even when recording is performed using a liquid discharge head including densely-disposed recording elements, and a recording apparatus including the liquid discharge head.

According to an aspect of the present invention, a liquid discharge head includes: a recording element substrate including a discharge port group configured to discharge liquid and a supply port configured to supply the liquid to the discharge port group; a supporting member including a liquid chamber configured to store the liquid therein, the supporting member being configured to support the recording element substrate; a flow path formed between the liquid chamber and the supply port and configured to allow the liquid to flow therethrough along a main surface of the recording element substrate on which the supply port opens; and a plurality of through holes communicating the liquid chamber with the flow path. A sum of opening areas of the plurality of through holes per unit area in a region having relatively high temperature in an in-plane direction of the main surface of the recording element substrate is greater than that in a region having relatively low temperature in the in-plane direction of the main surface of the recording element substrate.

According to exemplary embodiments of the present invention, the temperature distribution in the in-plane direction of the main surface of the recording element substrate can be uniformed by appropriately disposing in the recording element substrate the plurality of through holes configured to eject the ink. For this reason, the exemplary embodiments of the present invention can reduce recording density unevenness caused by the temperature distribution in the in-plane direction of the recording element substrate. The recording density unevenness occurs in the high-speed recording and in the recording element substrate including densely-disposed recording elements.

Further features of the present invention will become apparent from the following description of exemplary embodiments with reference to the attached drawings.

DESCRIPTION OF THE EMBODIMENTS

Hereinafter, a general ink jet recording head (hereinafter, referred to as a recording head) configured to discharge ink as liquid will be described as an example of a liquid discharge head according to each exemplary embodiment of the present invention.

In the present invention, the term "recording" is not limited to only the forming of significant information such as characters and graphics. In other words, the term "recording" can refer to forming something meaningless. In addition, the term "recording" does not necessarily refer to forming something visualized and perceptible by human eye. Furthermore, the term "recording" is defined broadly to include forming an image, a design, and a pattern or the like on a recording material, and processing a recording material.

In the present invention, the term "recording material" is not limited to paper used in a general recording apparatus, but also include anything that is ink receptible, for example, cloth, a plastic film, a metal plate, glass, ceramics, wood, and leather.

An example of a recording head according to a first exemplary embodiment will be described with reference to FIGS. 1A, 1B, 1C, and 1D. FIGS. 1A, 1B, 1C, and 1D illustrate the recording head according to the first exemplary embodiment. The recording head of the exemplary embodiment illustrated in FIGS. 1A, 1B, 1C, and 1D is obtained by applying the configuration of the present invention to the conventional recording head. In the specification, only the parts which relate to the recording head according to exemplary embodiments of the present invention are illustrated in order to simplify the description.

Figure 1A:
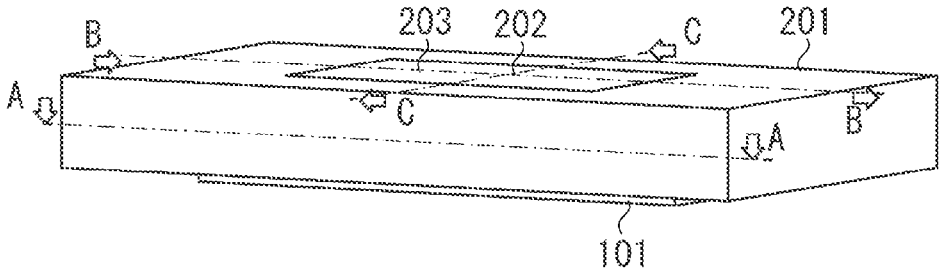
FIG. 1A is a perspective view of a recording head according to a first exemplary embodiment.
Figure 1B:
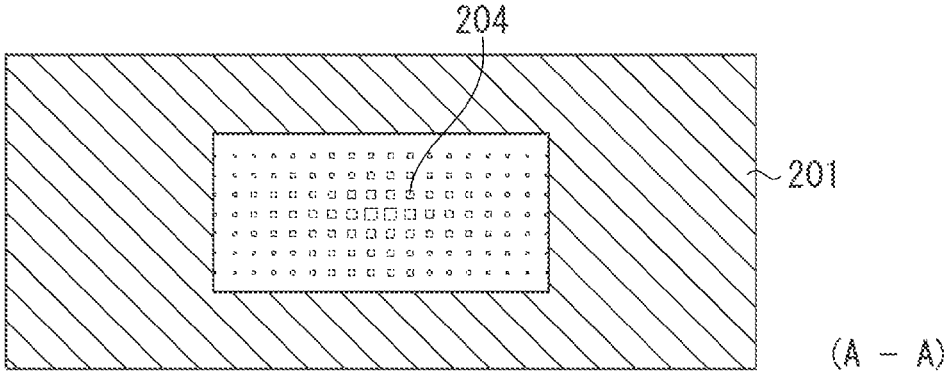
FIGS. 1B, 1C, and 1D are an A-A sectional view of FIG. 1A, a B-B sectional view of FIG. 1A, and a C-C sectional view of FIG. 1A, respectively.
Figure 1C:
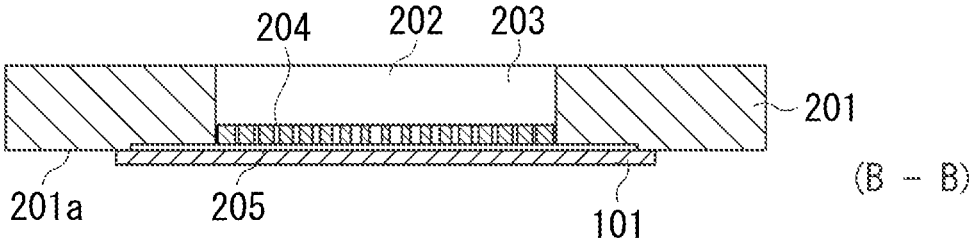
Figure 1D:
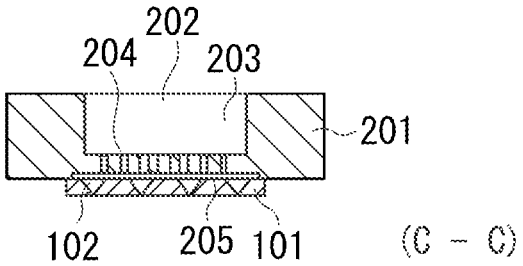

FIG. 1A illustrates an overall perspective view of the recording head. FIG. 1B illustrates a sectional view taken along line A-A. FIG. 1C illustrates a sectional view taken along line B-B. FIG. 1D illustrates a sectional view taken along line C-C.

As illustrated in FIGS. 1A to 1D, the recording head includes a recording element substrate 101 and a supporting member 201. The recording element substrate 101 includes a discharge port group configured to discharge ink and a supply port 102 configured to supply the ink to the discharge port group. The supporting member 201 includes a liquid chamber 203 configured to store the ink therein. The supporting member 201 is configured to support the recording element substrate 101.

A rear surface flow path 205 is formed between the liquid chamber 203 and the supply port 102. The ink flows in the rear surface flow path 205 along a main surface (rear surface) of the recording element substrate 101 on which the supply port 102 opens. As illustrated in FIGS. 1C and 1D, a recessed portion constituting the rear surface flow path 205 is formed on a support surface 201*a* side of the supporting member 201. The support surface 201*a* is configured to support the recording element substrate 101. The supporting member 201 is made of a resin material. The supporting member 201 may be made of a ceramic material.

The liquid chamber 203 and the rear surface flow path 205 are communicated with each other via a plurality of through holes 204. The sum of opening areas of the plurality of through holes 204 per unit area in a region having relatively high temperature in an in-plane direction of the rear surface of the recording element substrate 101 is greater than that in a region having relatively low temperature in the in-plane direction of the rear surface of the recording element substrate 101.

In other words, in the in-plane direction of the rear surface of the recording element substrate 101, the sum of the opening areas of the plurality of through holes 204 per unit area changes such that the sum gradually increases from a region where the temperature of the recording element substrate 101 is relatively low toward a region where the temperature is relatively high.

Figure 2A:
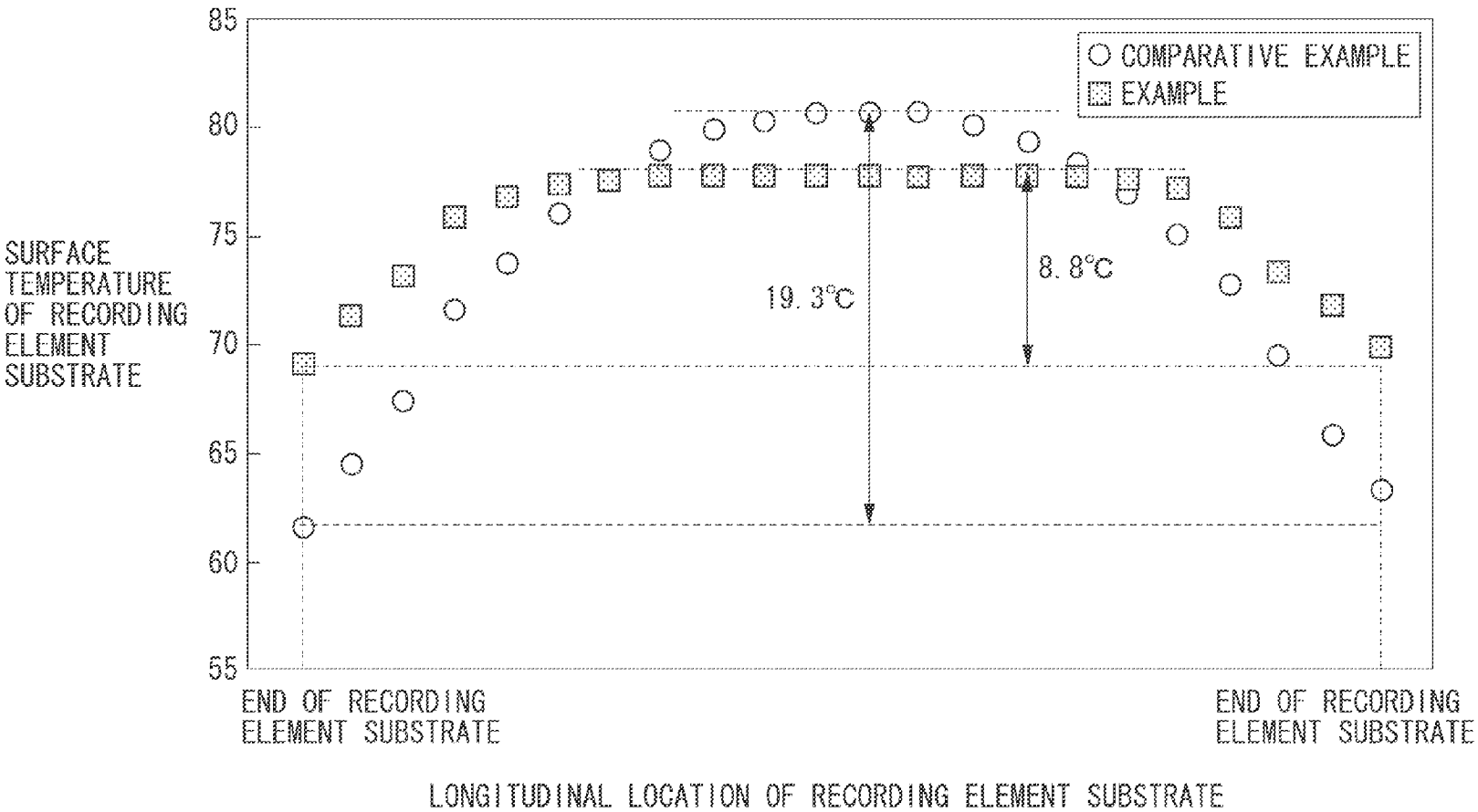
FIG. 2A illustrates temperature distribution occurring on a main surface of a recording element substrate in the recording head according to the first exemplary embodiment.

FIG. 2A illustrates longitudinal temperature distribution in the in-plane direction of the rear surface of the recording element substrate 101 for a configuration in which the plurality of through holes 204 are disposed according to the present exemplary embodiment of the present invention (example) and a configuration in which a porous member is disposed as described in Japanese Patent Application Laid-Open No. 2004-209764 (comparative example). In FIG. 2A, the exemplary embodiment (example) is represented by a square mark, and the comparative example is represented by a round mark.

In the recording element substrate 101 used in order to obtain a simulation result illustrated in FIG. 2A, a flow path height of the rear surface flow path 205 (a clearance between the recording element substrate 101 and the supporting member 201 in the thickness direction of the recording element substrate 101) is set to 0.13 mm, and the openings of the through holes 204 are formed into a square shape. The square openings of the through holes 204 have a side of 0.6 mm in the center portion of the rear surface of the recording element substrate 101. The through holes 204 are disposed such that the sides of the openings of the through holes 204 are gradually shortened toward the end of the rear surface of the recording element substrate 101 in increments of 5% in the long side direction of the recording element substrate 101 and in increments of 10% in the short side direction thereof.

As described above, in the recording head, generally, the temperature of the end of the rear surface of the recording element substrate 101 is relatively low while the temperature of the center portion of the rear surface of the recording element substrate 101 is relatively high. Therefore, in the present exemplary embodiment, in order to eliminate the temperature distribution, the opening area of the through hole 204 having a rectangular opening is formed relatively large near the center of the rear surface of the recording element substrate 101 instead of using the porous member as described in Japanese Patent Application Laid-Open No. 2004-209764. Thus, the opening area of the through hole 204 is formed relatively small near both ends in the long side direction and the short side direction on the rear surface of the recording element substrate 101. The through hole 204 is disposed near the rear surface (main surface) of the recording element substrate 101 on which the supply port 102 opens, which generates the flow (collision jet stream) of the ink passing through the through hole 204 to collide with the rear surface of the recording element substrate 101. The collision jet stream is generally known to promote thermal transfer. Much more heat of the recording element substrate 101 is transferred to the ink by the collision jet stream.

Figure 2B:
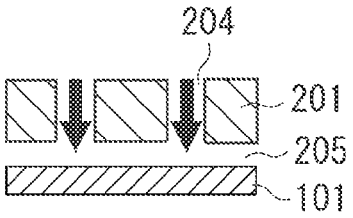
FIGS. 2B and 2C illustrate an effect of the flow of ink on the center and the end, respectively, of the main surface of the recording element substrate in the recording head according to the first exemplary embodiment.
Figure 2C:
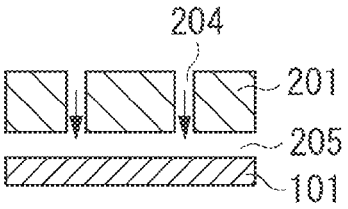

Furthermore, as in the present exemplary embodiment, the opening area of the through hole 204 is caused to vary according to the location in the in-plane direction of the rear surface of the recording element substrate 101 whereby a relatively large amount of ink flows in a region where the opening area of the through hole 204 is relatively large. Simultaneously, a relatively small amount of ink flows in a region where the opening area of the through hole 204 is relatively small. Thus, as illustrated in FIG. 2B, relatively strong collision jet stream hits the center portion of the rear surface of the recording element substrate 101. As illustrated in FIG. 2C, relatively weak collision jet stream hits both the ends in the long side direction and the short side direction on the rear surface of the recording element substrate 101. More specifically, the relatively strong collision jet stream hits a region where original heat is relatively high while the relatively weak collision jet stream hits a region where the heat is relatively low.

Thus, uneven collision jet stream hits the recording element substrate 101 according to the location in the in-plane direction of the rear surface of the recording element substrate 101, which attains the uniformity of the temperature distribution in the in-plane direction of the recording element substrate 101. Arrows in FIGS. 2B and 2C represent the flow of the ink. As the arrows are thicker and longer, the arrows represent stronger flow. The ink which collides with the recording element substrate 101 and receives the heat passes through the rear surface flow path 205 between the supporting member 201 and the recording element substrate 101. The ink is discharged from a discharge port via the supply port 102.

Figure 2D:
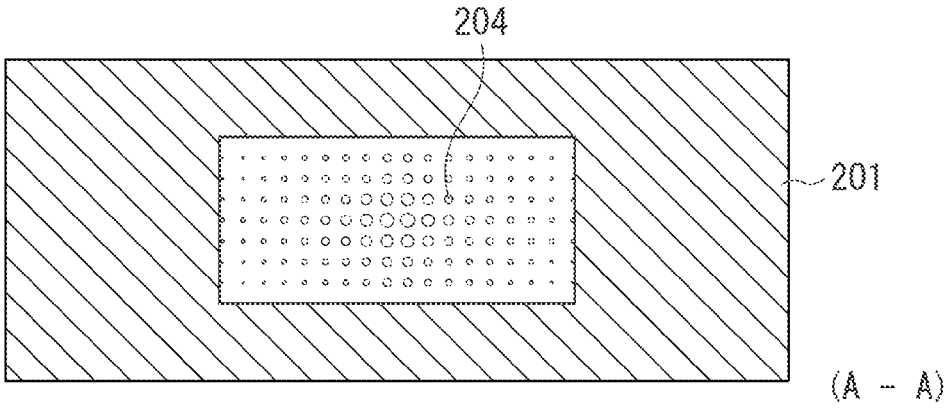
FIG. 2D is an A-A sectional view of FIG. 1A and illustrates another opening shape of a through hole.

As for the temperature distribution in the in-plane direction of the recording element substrate 101, the present exemplary embodiment can be applied to any case where the temperature of the center portion of the rear surface is relatively high, and the temperatures of both the ends in the long side direction and the short side direction are relatively low. The present exemplary embodiment of the present invention can be applied regardless of the shape of the liquid chamber 203 and the location of an inflow port. Therefore, the present exemplary embodiment can be applied to a configuration in which the shapes of a liquid chamber inflow port 202 and the liquid chamber 203 included in the supporting member 201 different from those illustrated in FIGS. 1A, 1B, 1C, and 1D. Herein, in the configuration illustrated in FIG. 1B, the opening shape of the through hole 204 is a rectangle. However, the opening shape of the through hole 204 may be a circle as illustrated in FIG. 2D. In addition, other shapes may also be appropriately selected.

In the present exemplary embodiment, the case where the temperature of the center portion of the rear surface of the recording element substrate 101 is relatively high is described. However, the present exemplary embodiment can also be applied to a case where the temperature of the end of the rear surface of the recording element substrate 101 is relatively high. When the temperature of the end of the rear surface of the recording element substrate 101 is relatively high, the opening area of the through hole 204 may be relatively small near the center of the rear surface of the recording element substrate 101, and the opening area may be relatively large near both the ends of the rear surface of the recording element substrate 101.

As described above, in the recording head according to the present exemplary embodiment, the ink which is supplied from the plurality of through holes 204 communicated with the rear surface flow path 205 between the recording element substrate 101 and the supporting member 201 collides with the recording element substrate 101. Thus, the heat is transferred to the ink from the recording element substrate 101, which makes it possible to lower the temperature of the recording element substrate 101.

The plurality of through holes 204 are disposed with an opening shape, a size, and a distance adjusted according to the temperature distribution of the rear surface of the recording element substrate 101. Thus, the strength of ink jet stream colliding with the recording element substrate 101 can be changed according to the location in the in-plane direction of the recording element substrate 101, to change the quantity of the heat transferred to the ink from the recording element substrate 101 according to the location in the in-plane direction of the rear surface of the recording element substrate 101. As a result, in the recording head according to the present exemplary embodiment, the temperature distribution in the in-plane direction of the recording element substrate 101 is uniformed, which can suppress a temperature difference occurring on the rear surface of the recording element substrate 101.

Then, a recording head according to another exemplary embodiment will be described. In another exemplary embodiment, for the sake of simplicity, the same reference numerals as those of the first exemplary embodiment are given to the same components as those of the first exemplary embodiment, and accordingly, descriptions thereof are omitted.

Figure 3A:
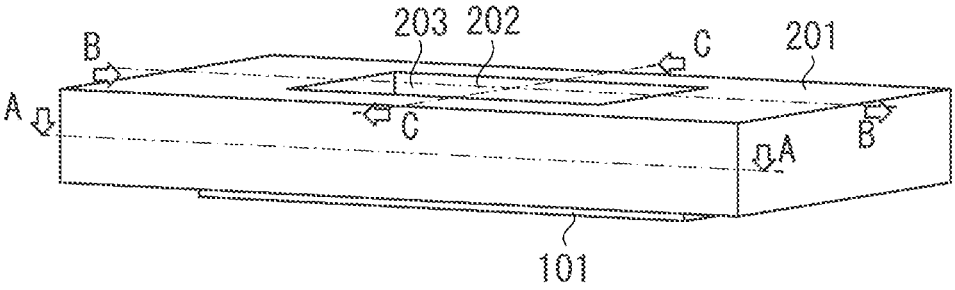
FIG. 3A is a perspective view of a recording head according to a second exemplary embodiment.
Figure 3B:
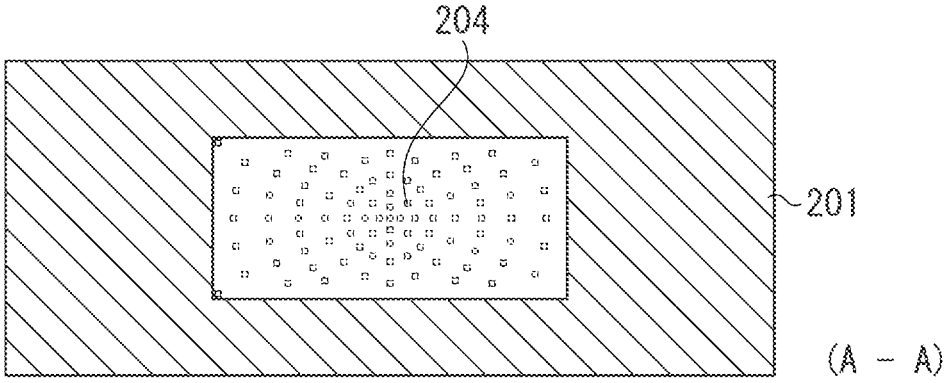
FIGS. 3B, 3C, and 3D are an A-A sectional view of FIG. 3A, a B-B sectional view of FIG. 3A, and a C-C sectional view of FIG. 3A, respectively.
Figure 3C:
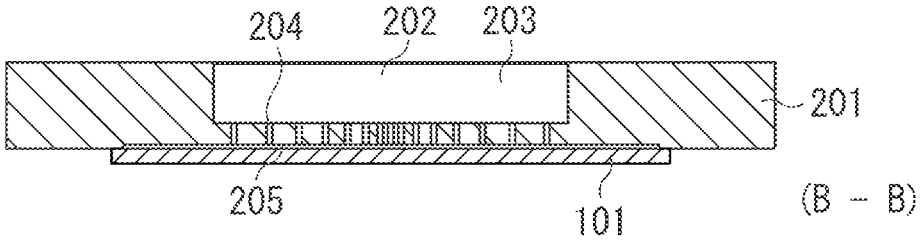
Figure 3D:
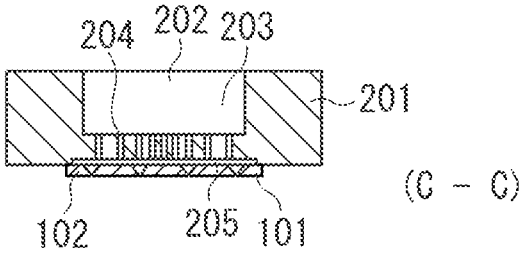

A configuration example of a second exemplary embodiment will be described with reference to FIGS. 3A, 3B, 3C, and 3D. FIGS. 3A, 3B, 3C, and 3D illustrate a recording head according to the second exemplary embodiment. FIG. 3A illustrates an overall perspective view of the recording head. FIG. 3B illustrates a sectional view taken along line A-A. FIG. 3C illustrates a sectional view taken along line B-B. FIG. 3D illustrates a sectional view taken along line C-C.

As illustrated in FIG. 3B, in the second exemplary embodiment, through holes 204 are provided in a state where the number density of the through holes 204 is relatively dense near the center of the rear surface of a recording element substrate 101 while it is relatively sparse near both the ends of the rear surface of the recording element substrate 101. When the through holes 204 are relatively densely provided, the number of collision jet streams of ink colliding with the recording element substrate 101 relatively increases, thereby transferring a large amount of heat from the recording element substrate 101 to the ink. When the through holes 204 are provided in a state where the number density of the through holes 204 is relatively sparse, little heat is transferred to the ink. Therefore, the number density of the through holes 204 is changed according to the location in the in-plane direction of the rear surface of the recording element substrate 101, which attains the uniformity of the temperature distribution in the in-plane direction of the recording element substrate 101.

Herein, the opening shape of the through hole 204 is not limited to the rectangular shape as illustrated in FIG. 2B. A plurality of circular through holes 204 may be arranged as in modification of the first exemplary embodiment (FIG. 2D). The opening shape may be a composite shape of a circle and a rectangle. Examples of the composite shape include an elongate hole shape (elliptical shape) and a quadrangle having four corners formed in a circular arc shape.

In the present exemplary embodiment, the case where the temperature of the center portion of the rear surface of the recording element substrate 101 is relatively high is described. However, the exemplary embodiments of the present invention can also be applied to a case where the temperature of the end of the rear surface of the recording element substrate 101 is relatively high. When the temperature of the end of the rear surface of the recording element substrate 101 is relatively high, the through holes 204 may be provided in a state where the number density of the through holes 204 is relatively sparse near the center of the rear surface of the recording element substrate 101 while it is relatively dense near both the ends of the rear surface of the recording element substrate 101. Also in the second exemplary embodiment, the same effect as that of the first exemplary embodiment can be obtained.

In the first and second exemplary embodiments, for the temperature distribution in both the long side direction and short side direction of the rear surface of the recording element substrate 101, the configuration examples in which the opening shape and arrangement of the through holes 204 are changed in both the long side direction and the short side direction are described. In a third exemplary embodiment, a case where temperature distribution is improved in not both the long side direction and short side direction of a recording element substrate 101 but only in any one of the directions will be described. The third exemplary embodiment is configured for the purpose of improving the temperature distribution only in the long side direction of the recording element substrate 101. A recording head according to the third exemplary embodiment will be described with reference to FIGS. 4A, 4B, 4C, 4D, and 4E.

Figure 4A:
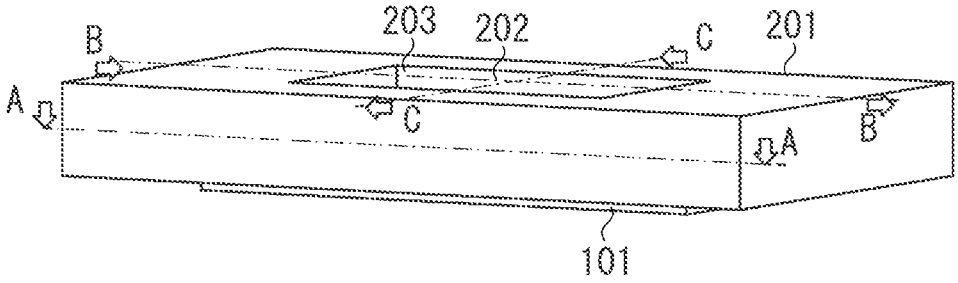
FIG. 4A is a perspective view of a recording head according to a third exemplary embodiment.
Figure 4B:
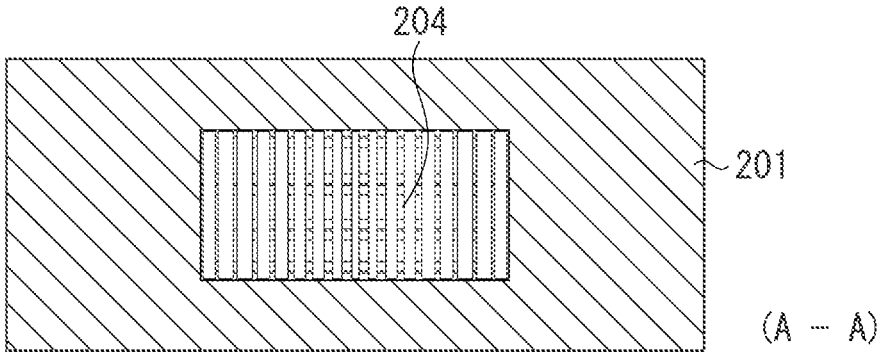
FIGS. 4B, 4C, and 4D are an A-A sectional view of FIG. 4A, a B-B sectional view of FIG. 4A, and a C-C sectional view of FIG. 4A, respectively.
Figure 4C:
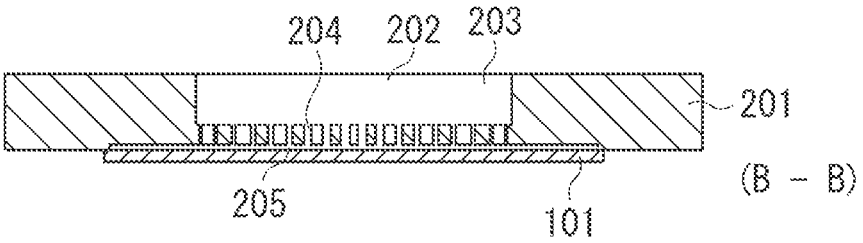
Figure 4D:
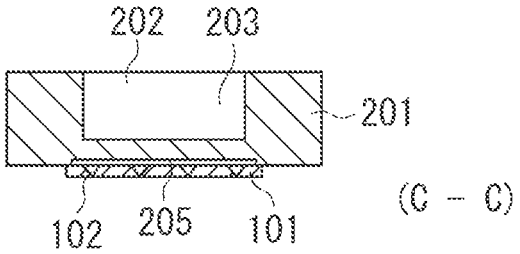

FIG. 4A illustrates an overall perspective view of the recording head. FIG. 4B illustrates a sectional view taken along line A-A. FIG. 4C illustrates a sectional view taken along line B-B. FIG. 4D illustrates a sectional view taken along line C-C.

As described above, generally, the temperature of the end of the rear surface of the recording element substrate 101 is relatively low, and the temperature of the center portion of the rear surface of the recording element substrate 101 is relatively high. The third exemplary embodiment is directed to improving temperature distribution only in the long side direction of the recording element substrate 101 in order to eliminate such temperature distribution. The opening area of a through hole 204 having a rectangular opening shape is relatively large near the center of the rear surface of the recording element substrate 101. The opening area of the through hole 204 is relatively small near both the ends in the long side direction of the recording element substrate 101. Since temperature distribution in the short side direction of the recording element substrate 101 is not considered in the present exemplary embodiment, the through hole 204 opens in an equal width in the short side direction.

Such a configuration can improve the temperature distribution in the long side direction of the rear surface of the recording element substrate 101. In the configuration, if it is not necessary to improve the temperature distribution in the short side direction of the rear surface of the recording element substrate 101 while it is necessary to improve the temperature distribution in the long side direction, the total number of the through holes 204 can be reduced. For this reason, according to the present exemplary embodiment, the formation step of the through holes 204 can be facilitated compared with those of the first and second exemplary embodiments.

Figure 4E:
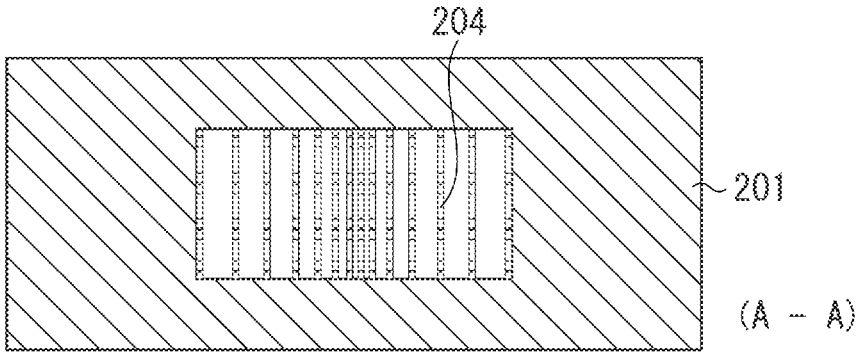
FIG. 4E is an A-A sectional view of FIG. 4A and illustrates another opening shape of a through hole.

Furthermore, in the present exemplary embodiment, the opening area of the through hole 204 is changed according to the location in the in-plane direction of the rear surface of the recording element substrate 101, which attains the improvement of the temperature distribution. However, the exemplary embodiments of the present invention are not limited to the configuration. For example, as illustrated in FIG. 4E, the number density of the through holes 204 may be changed according to the location in the in-plane direction of the rear surface of the recording element substrate 101, which can obtain the same effect as that of the present exemplary embodiment. Such a configuration utilizes an increased cooling effect in the region where the number of the through holes 204 is relatively large and a decreased cooling effect in the region where the number of the through holes 204 is relatively small, as described in the second exemplary embodiment. Of course, the opening shape of the through hole 204 is not limited to the rectangular shape, and may be appropriately changed if needed.

In the present exemplary embodiment, the case where the temperature of the center portion of the rear surface of the recording element substrate 101 is relatively high is described. However, the exemplary embodiments of the present invention can also be applied to a case where the temperature of the end (outer peripheral portion) of the rear surface of the recording element substrate 101 is relatively high. When the temperature of the end of the rear surface of the recording element substrate 101 is relatively high, as in the first and second exemplary embodiments, the through holes 204 may be provided in a state where the opening areas of the through holes 204 are relatively small near the center of the rear surface of the recording element substrate 101, or may be provided in a state where the number density is relatively sparse. Simultaneously, in this case, the through holes 204 may be provided in a state where the opening areas of the through holes 204 are relatively large near both the ends in the long side direction and short side direction of the rear surface of the recording element substrate 101, or may be provided in a state where the number density is relatively dense.

The present exemplary embodiment is directed to improving the temperature distribution in the long side direction of the rear surface of the recording element substrate 101. However, when the present exemplary embodiment is directed to improving the temperature distribution in the short side direction, a short side and a long side in the oblong opening of the through hole 204 may be replaced with each other. More specifically, the opening size of the through hole 204 may be relatively large in the long side direction of the recording element substrate 101, and the opening size of the through hole 204 may be relatively small in the short side direction. As well as forming the opening shape in such a hole shape, the opening area of the through hole 204 in the center portion of the rear surface of the recording element substrate 101 is made relatively large while that of the end of the rear surface is made relatively small, which can correspond to the temperature distribution in the short side direction.

In the first to third exemplary embodiments, only one recording element substrate 101 is described. In a forth exemplary embodiment, a plurality of recording element substrates 101 are disposed next to each other. A long recording head will be described.

Figure 5A:
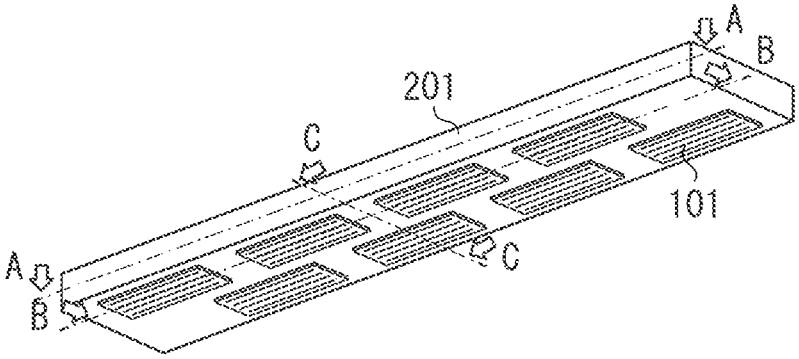
FIG. 5A, is a perspective view of a recording head according to a fourth exemplary embodiment.
Figure 5B:
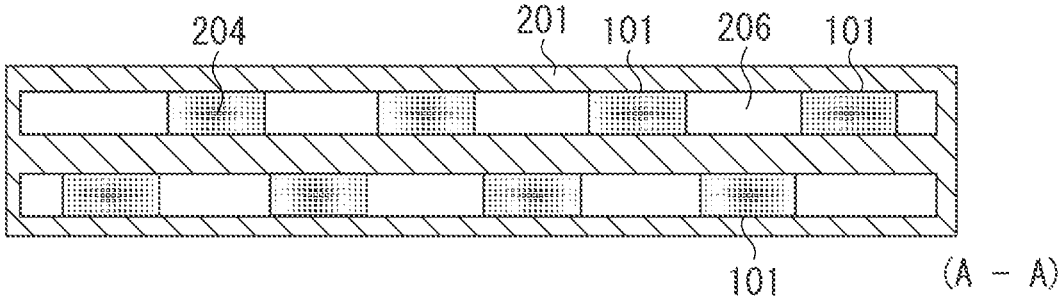
FIGS. 5B, 5C, and 5D are an A-A sectional view of FIG. 5A, a B-B sectional view of FIG. 5A, and a C-C sectional view of FIG. 5A, respectively.
Figure 5C:
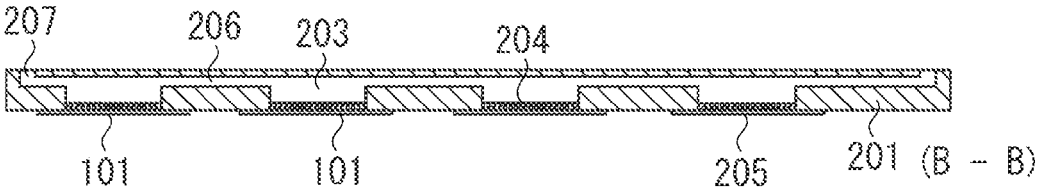
Figure 5D:
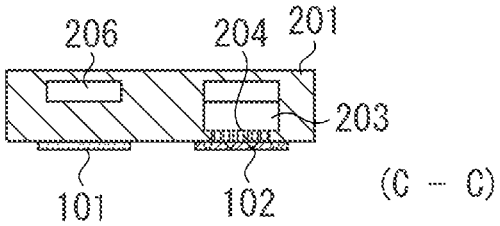

FIGS. 5A, 5B, 5C, 5D, and 5E illustrate a recording head according to the fourth exemplary embodiment. FIG. 5A illustrates an overall perspective view of the recording head. FIG. 5B illustrates a sectional view taken along line A-A. FIG. 5C illustrates a sectional view taken along line B-B. FIG. 5D illustrates a sectional view taken along line C-C.

As illustrated in FIGS. 5A, 5B, 5C, 5D, and 5E, the recording head of the present exemplary embodiment has a configuration in which ink to be discharged passes through a liquid chamber connecting flow path 206 via a head inflow port 207 from an unillustrated ink supplying source (ink tank), and is supplied to the liquid chamber inflow port 202 and the liquid chamber 203. The ink in the liquid chamber 203 of the supporting member 201 passes through the through hole 204, the rear surface flow path 205 between the supporting member 201 and the recording element substrate 101, and the supply port 102, and then, it is discharged from a discharge port of the recording element substrate 101. The long recording head constituted by arranging the plurality of recording element substrates 101 is referred to as a line head. The line head is used when a recording object is a large recording paper or when high-speed recording is performed.

Figure 5E:
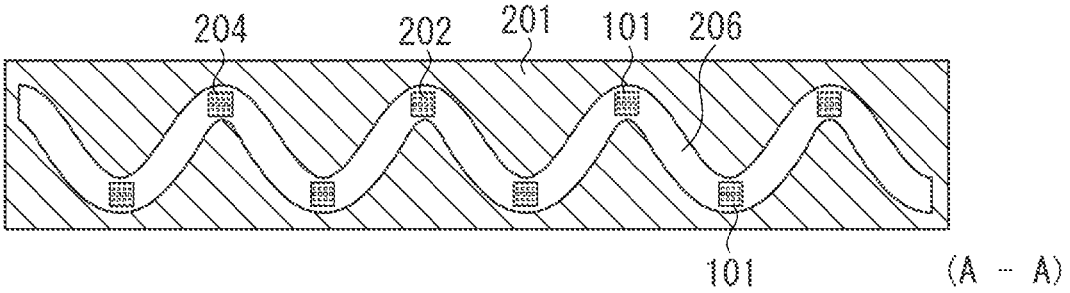
FIG. 5E is an A-A sectional view of FIG. 5A and illustrates a configuration example of another liquid chamber connecting flow path.

The liquid chamber connecting flow path 206 communicating the liquid chambers 203 with each other in the line head is illustrated in a linear shape in FIGS. 5A to 5D. However, the shape of the liquid chamber connecting flow path 206 may be another shape. For example, as illustrated in FIG. 5E, the shape of the liquid chamber connecting flow path 206 may be a meandering shape. As long as the ink can flow into each of the liquid chambers 203 from the ink tank, a suitable shape may be selected.

The temperature distributions of the rear surfaces of each of the recording element substrates 101 are considered to be different according to factors such as the shape of the liquid chamber connecting flow path 206, and the material of the supporting member 201. In such a case, for each of the liquid chambers 203, configurations such as the shape and arrangement of the through holes 204 are changed according to the temperature distributions of the rear surfaces of the recording element substrates 101. In the exemplary embodiment illustrated in FIGS. 5A, 5B, 5C, 5D, and 5E, the eight recording element substrates 101 are arranged. However, the number thereof is not limited. The number of the recording element substrates 101 may be decreased or increased if needed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-022313 filed Feb. 7, 2013, which is hereby incorporated by reference herein in its entirety.

What is claimed is:

1. A liquid discharge head comprising:

a recording element substrate including a discharge port group configured to discharge liquid and a supply port configured to supply the liquid to the discharge port group;

a supporting member including a liquid chamber configured to store the liquid therein, the supporting member being configured to support the recording element substrate;

a flow path formed between the liquid chamber and the supply port and configured to allow the liquid to flow therethrough along a main surface of the recording element substrate on which the supply port opens; and a plurality of through holes communicating the liquid chamber with the flow path, wherein a sum of opening areas of the plurality of through holes per unit area in a region having relatively high temperature in an in-plane direction of the main surface of the recording element substrate is greater than that in a region having relatively low temperature in the in-plane direction of the main surface of the recording element substrate.

2. The liquid discharge head according to claim 1, wherein the opening area of each of the through holes in the region having relatively high temperature in the recording element substrate is greater than that in the region having relatively low temperature in the recording element substrate.

3. The liquid discharge head according to claim 1, wherein a number density of the plurality of through holes in the region having relatively high temperature in the recording element substrate is higher than that in the region having relatively low temperature in the recording element substrate.

4. The liquid discharge head according to claim 1, wherein the plurality of through holes are formed in the supporting member.

5. The liquid discharge head according to claim 1, wherein an opening shape of each of the plurality of through holes is a circle, a rectangle, or a composite shape of the circle and the rectangle.

6. The liquid discharge head according to claim 1, wherein a recessed portion formed on a support surface of the supporting member configured to support the recording element substrate constitutes the flow path.

7. The liquid discharge head according to claim 1, wherein the supporting member is made of a resin material.

8. The liquid discharge head according to claim 1, wherein the supporting member is made of a ceramic material.

9. A recording apparatus configured to perform recording on a recording material using the liquid discharge head according to claim 1.

* * * * *